US006715952B1

(12) United States Patent
Aiken et al.

(10) Patent No.: US 6,715,952 B1
(45) Date of Patent: Apr. 6, 2004

(54) PORTABLE TOOTHBRUSH

(76) Inventors: Ricardo Aiken, 51 Scotland Rd., Chestnut Ridge, NY (US) 10977; Reisha Roopchand, 59 Pine Lake Ter., Rivervale, NJ (US) 07675

( * ) Notice: Subject to any disclaimer, the term of this patent is extended or adjusted under 35 U.S.C. 154(b) by 0 days.

(21) Appl. No.: 10/063,690

(22) Filed: May 8, 2002

(51) Int. Cl.[7] ..... A46B 11/04; B43K 5/14
(52) U.S. Cl. ..... 401/282; 401/132; 401/183
(58) Field of Search ..... 401/282, 287, 401/291, 183, 184, 185, 132, 133

(56) References Cited

U.S. PATENT DOCUMENTS 1,003,159 A * 9/1911 Stewart ..... 401/123
1,811,833 A * 6/1931 Simon ..... 401/132
1,947,721 A * 2/1934 Laub ..... 401/132
3,353,898 A * 11/1967 Lamberti ..... 401/132
3,356,095 A * 12/1967 Tylle ..... 401/132
5,033,898 A * 7/1991 Williams ..... 401/283
5,304,009 A * 4/1994 Marshall ..... 401/268

FOREIGN PATENT DOCUMENTS

FR 2696916 * 4/1994 ..... 401/132

* cited by examiner

*Primary Examiner*—David J. Walczak
(74) *Attorney, Agent, or Firm*—Richard A. Joel, Esq.

(57) ABSTRACT

A self-contained portable toothbrush comprises a plastic head having a plurality of bristles extending outwardly therefrom on one side and a hemispherical water pocket on the other side connected to the bristles by a plurality of channels extending through the head. The water pocket is composed of compressible plastic that ruptures a seal when pressed forcing water onto the bristles that contain dehydrated dentifrice. The head is joined to an intermediate coupling portion at one end which is joined at the other end to a detachable hollow handle portion contained water or mouthwash. After use, the toothbrush is discarded.

8 Claims, 3 Drawing Sheets

PORTABLE TOOTHBRUSH

BACKGROUND OF INVENTION

This invention relates to toothbrushes and particularly portable toothbrushes that are self contained and disposable.

Rather than carrying a toothbrush and toothpaste separately and then looking for a water source, applicant's invention permits carrying the brush alone and its use in any environment. This invention is patentably distinguishable over the prior art that includes the following patents discussed below.

U.S. Pat. No. 5,304,009 to Marshall is directed to a disposable toothbrush that includes dehydrated toothpaste on the bristles and a mouthwash reservoir in the handle. The brush depends on saliva to moisten the bristles and activate the dehydrated toothpaste.

U.S. Pat. No. 5,915,868 to Frazill discloses a self-contained dentifrice package on the head of a toothbrush which is enclosed by a soft plastic covering and which releases dentifrice through a plurality of hollow needles to the bristles. Another patent of interest is U.S. Pat. No. 5,769,553 to Chaudhri, depicts a toothbrush having a ram for expelling toothpaste through a passage to the bristle end of the brush where the toothpaste enters through channels adjacent the bristles.

U.S. Pat. No. 6,331,088 to Owens discloses a toothbrush with multiple pumping stations while U.S. Pat. No. 6,315,556 to Stewart discloses a fluid supply that extends into the bristle head.

Other patents of interest are U.S. Pat. No. 5,966,769 to Tortorice; U.S. Pat. No. 5,842,487 to Ledet; U.S. Pat. No. 4,963,046 to Eguchi; U.S. Pat. No. 4,685,819 to Endo; and, U.S. Pat. No. 5,062,728 to Kuo.

applicant's invention, however, is uniquely different from the prior art patents and has advantages thereover in ease and desirability of use and cost.

SUMMARY OF INVENTION

This invention is a portable toothbrush that is easy to use and disposable. The toothbrush comprises a plastic head having bristles protruding outwardly from one side at a right angle and a sealed plastic bubble or reservoir containing water on the other side. The bristles contain dehydrated toothpaste that is moistened by pressing the plastic bubble that breaks a seal and releases water through a plurality of channels in the plastic head to the bristles.

The head is joined to an intermediate coupling portion at one end. An elongated hollow handle is mounted to the other end of the intermediate portion. The handle is detachable and contains water or mouthwash that is used during or after a brushing operation. The moistening of the bristles with water from the plastic bubble rather than depending on saliva provides better brushing and a more satisfying experience.

Accordingly, an object of this invention is to provide a new and improved disposable toothbrush.

Another object of this invention is to provide a new and improved portable toothbrush having a water supply on the head that is readily channeled to the bristles.

A further object of this invention is to provide a new and improved portable toothbrush that includes a self-moistening head with dehydrated toothpaste on the bristles and an end handle portion with a water supply contained therein and readily detachable.

A more specific object of this invention is to provide a new and improved disposable toothbrush having a sealed water supply mounted on the head to moisten bristles with dehydrated toothpaste through a plurality of channels when the plastic seal is broken by pressing a compressible plastic bubble encompassing the water supply and providing a further water supply in a detachable handle.

BBRIEF DESCRIPTION OF DRAWINGS

The above and other objects and advantages of this invention may be more clearly seen when viewed in conjunction with the accompanying drawings wherein.

FIG. 4 is a further variation on the invention, and.

DETAILED DESCRIPTION

The invention comprises a portable disposable toothbrush 10 having a compressible water reservoir 11 on the head 1 2 that moistens the bristles 13 when squeezed.

Figure 1:
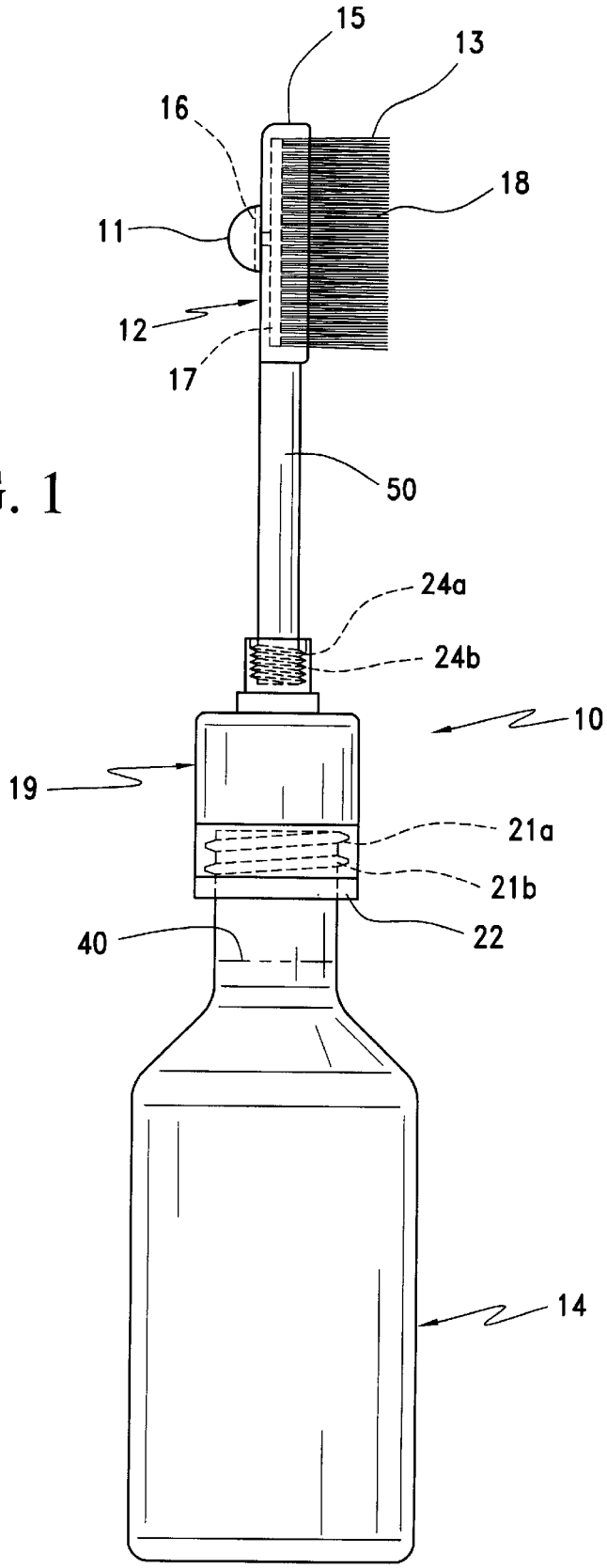
FIG. 1 is a side view of the portable toothbrush comprising the invention.
Figure 2:
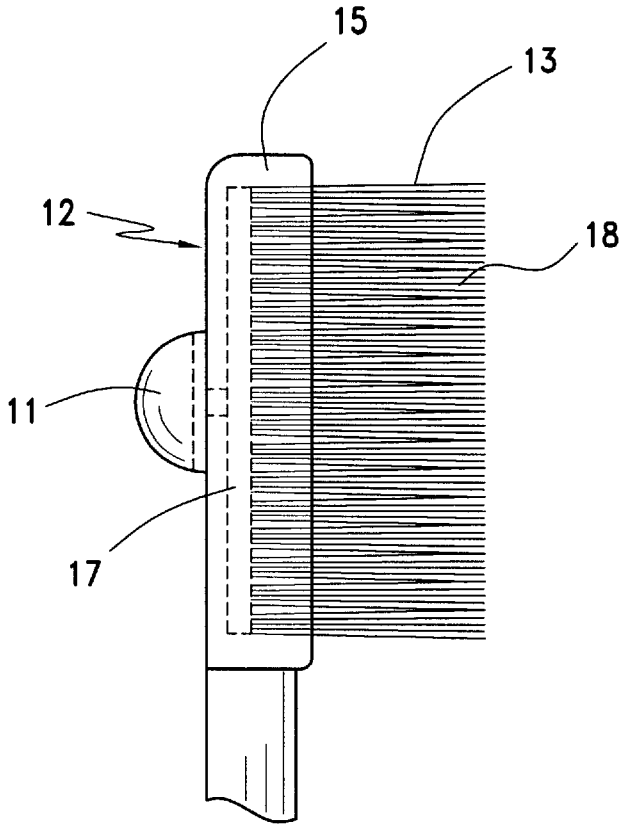
FIG. 2 is an exploded side view of the portable toothbrush head comprising the invention.

As seen in FIG. 1, the toothbrush 10 comprises a head 12 at one end, an intermediate portion 19 and an elongated hollow handle or bottle 14 at the other end. The head 12 includes a plurality of bristles 13 extending perpendicularly outward from one side of a plastic base 15, see FIG. 3. The water reservoir or bubble 11 is mounted on the other side of the plastic base 15. The bubble 11 is composed of compressible plastic with a breakable seal 16 adjacent the plastic base 15. The base 15 includes a plurality of channels 17 extending through the base 15 to permit directing the water precisely to the spaced bristles 13. Optionally the water pocket 11 may be located within the head 15 and side levers (not shown) could be used to puncture the pocket 11 and release water through water channels 17 to moisten the bristles 13.

The bristles 13 contain dehydrated toothpaste 18 that is moistened by rupturing the seal on the bubble 11. The toothbrush 10, therefore, requires no independent water or toothpaste source for brushing. The toothbrush 10 thereby simulates conventional brushing with the moistened bristles 13. The toothbrush neck 50 and hollow container cap 19 are one unit. The neck 50 includes external threads 24*a*, which mesh with threads 24*b* on the cap 19. When the cap 19 of the water bottle/hollow container 14 is unscrewed so is the toothbrush portion. The water bottle/hollow container 14 is connected to the toothbrush portion by means of threads incorporated into the cap 19 (toothbrush portion) of the water bottle. The portion 19 extends outwardly to engage the enlarged handle or bottle 14.

The elongated hollow handle or bottle 14 contains water or mouthwash to rinse one's mouth after brushing. The handle 14 is fastened to the intermediate portion 19 by cooperating threads 21*a*, 21*b* inside of the cap 19. A removable seal cover 22 may he used to open upper portion of the handle or bottle 14 to protect and to maintain the water in place. Alternately, an ordinary miniature water bottle 14 may he attached to the intermediate section 19 instead of a hollow handle.

In use, one presses the bubble 11 to break the more frangible seal 16 and force water from the bubble 11 onto the bristles 13 through a plurality of predetermined channels 17 which are precisely spaced to direct water to the dehydrated toothpaste 18 on the bristles 13. The user then brushes his or her teeth. The handle or bottle 14 is then detached, the seal, if present, is removed and the water or mouthwash used to rinse one's mouth. After use, the toothbrush 10 which is easy to make and inexpensive, is discarded.

Thus, in traveling, it is not necessary to carry separate toothpaste, water and toothbrush. A prime advantage of this invention is its portability and convenience. Indeed the toothbrush 10 may be carried in sections that are threaded together.

Figure 3:
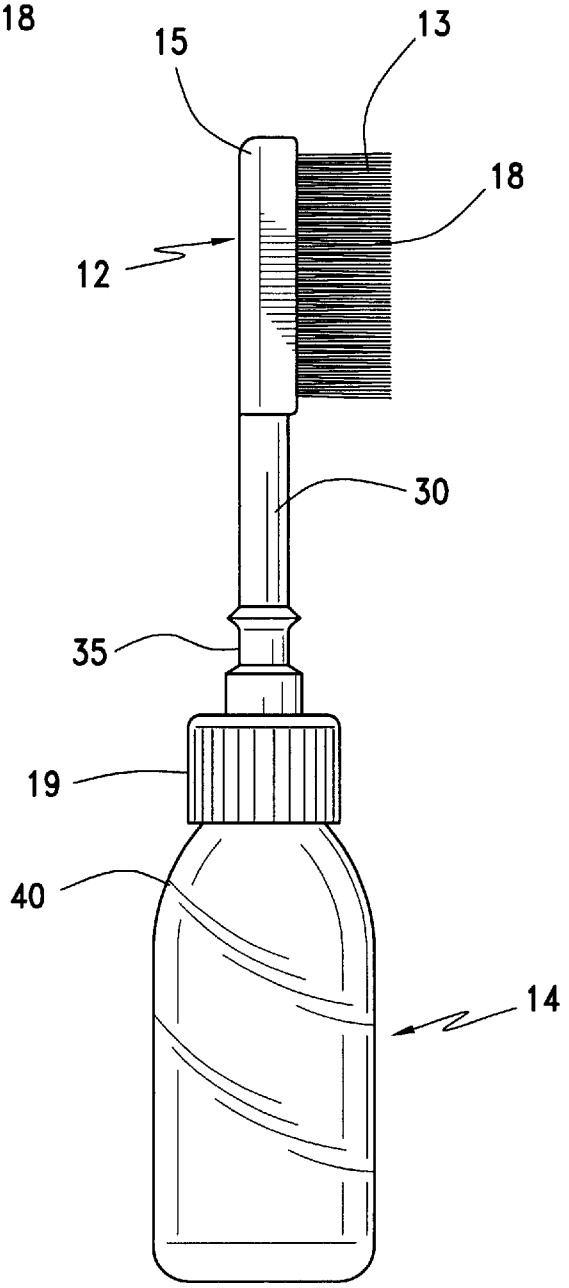
FIG. 3 is an alternate embodiment of the invention.

In the alternate embodiment of FIG. 3, the bubble 11 of FIG. 1 is not included. The intermediate section 19 includes a channel 30 that extends through the head 12 to wet the bristles 13. Water 40 flows from the bottle 14 to wet the bristles 13 when a stopper or seal is removed and the bottle is squeezed. In another version, the portion 35 may be pulled upwardly to provide a channel from the water bottle 14 to the bristles 13. When the stopper is removed or the portion 35 pulled outwardly, holding the bristle end of the toothbrush downward will moisten the bristles 13 by squeezing the toothbrush handle i.e. the water bottle 14. Water is forced through the water tube or channel 30 onto the bristles 13. The bottle 14 may be detached to wash one's mouth. A straw or tube (not shown) may extend from any portion of the unit to be used to moisten the bristles.

Alternately, the bottle 14 may be removed and used initially to wet the bristles 13. Miniature water bottles or containers 14 may be shaped like cartoon characters, animals, super heroes, etc. to appeal to children.

Figure 4:
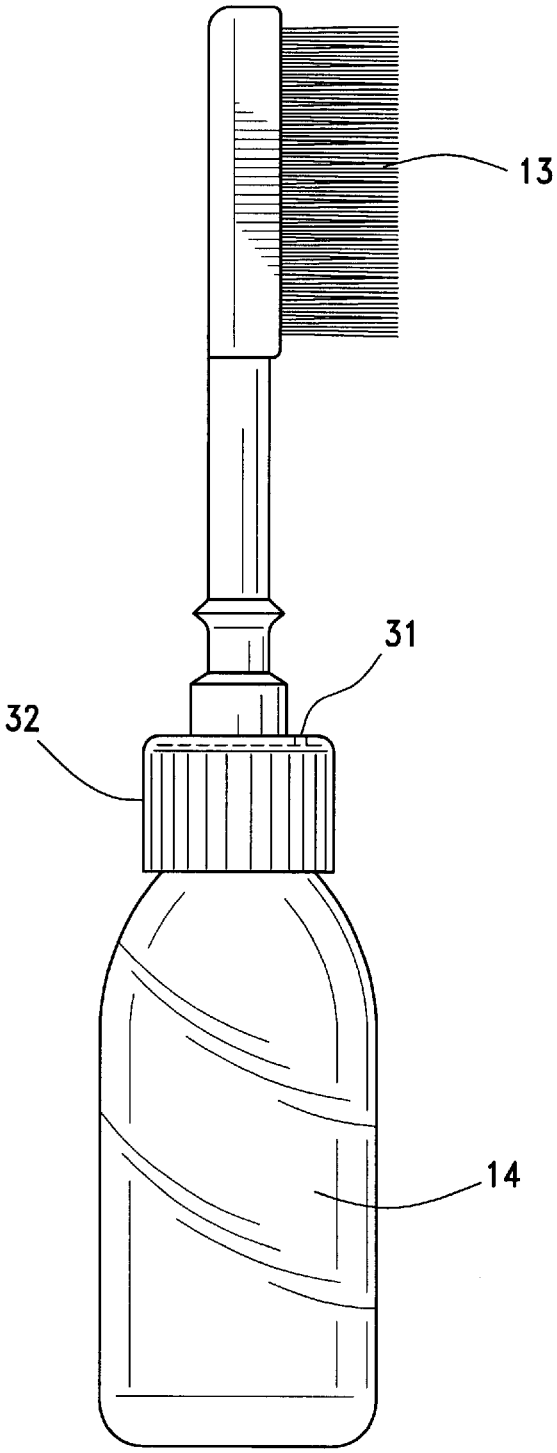

Finally as shown in FIG. 4, water may be sprayed through a pinhole 31 in the flat surface of the cap 32 to wet the bristles 13. A tab (not shown) is removed or broken off to expose a pinhole 31 in the cap FIG. 4. Holding the bristle end of the toothbrush downward and then squeezing the toothbrush handle 14 i.e. the water bottle will deliver water through the pinhole 31 to moisten the bristles 13.

Figure 5:
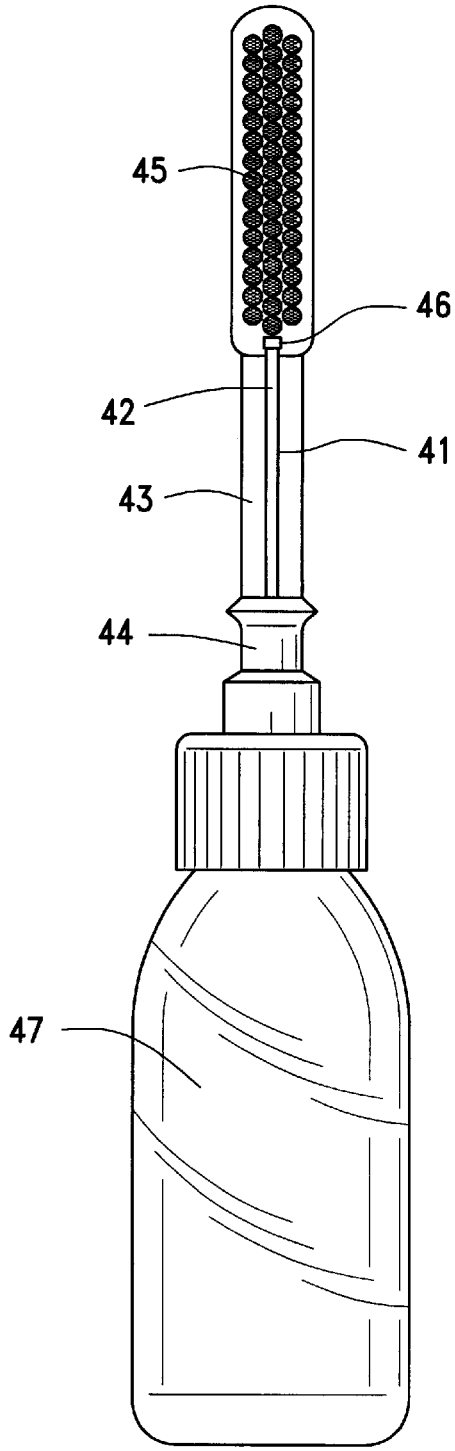
FIG. 5 is an alternate embodiment of the invention.

FIG. 5 shows a further embodiment of the invention with the water tube 41 and water channel 42 located on the outside of the toothbrush neck 43. This water tube 41 extends from the cap 44 up the middle of the outside of the toothbrush neck 43 on the same side as the bristles 45. At the end of the water tube 41 towards the bristles 45, the tube 41 is blocked with a tip stopper 46, etc. When the stopper 46 is removed, the bristles 45 can be moistened by holding the bristle end of the toothbrush 10 downward and squeezing the water bottle 47. Water is then forced through the water tube 41 into the water channel 42 where it will run the remaining distance onto the bristles 45.

While the invention has been explained by a detailed description of certain specific embodiments, it is understood that various modifications and substitutions can be made in any of them within the scope of the appended claims, which are intended also to include equivalents of such embodiments.

What is claimed is:

1. A portable toothbrush comprising:

a head having a plastic base, a plurality of spaced bristles extending perpendicularly outward on one side thereof, a plastic bubble mounted on the other side thereof having water contained in said bubble and having a breakable bubble seal engaging the base, and a plurality of spaced channels extending through the head to direct water from the bubble to the bristles when the seal is broken;

an intermediate portion removably mounted to the head at one end; and, a hollow handle having an open end removably mounted to the other end of the intermediate portion and having water contained therein and a seal positioned over the open end to maintain the water in the handle.

2. A portable toothbrush in accordance with claim 1 wherein:

the bristles include dehydrated dentifrice that is contacted by water from the bubble upon compression thereof.

3. A portable toothbrush in accordance with claim 2 wherein:

the intermediate portion includes a threaded portion and the open end of the hollow handle includes threads that engage the threads on the intermediate portion.

4. A portable toothbrush in accordance with claim 2 wherein:

the intermediate portion projects outwardly from the head and includes a threaded end portion and the handle includes a threaded open end that engages the threaded end of the intermediate portion.

5. A portable toothbrush in accordance with claim 1 wherein:

the hollow handle comprises a miniature water bottle and the intermediate portion comprises a cap.

6. A portable toothbrush in accordance with claim 1 wherein:

the hollow handle comprises a cartoon character.

7. A portable toothbrush comprising:

a head having a plastic base;

a plurality of bristles extending perpendicularly outwardly on one side of the base and including dehydrated dentifrice on said bristles;

an intermediate cap portion having a flat surface mounted to the head at one end, said surface having a pinhole and a frangible seal covering said hole;

a flexible hollow handle mounted to the other end of the intermediate cap portion and containing water, and wherein water is sprayed through the pinhole onto the bristles breaking the frangible seal when the handle is squeezed.

8. A portable toothbrush in accordance with claim 7 wherein:

the pinhole seal comprises a removable tab that permits the flow of water when the tab is removed.

* * * * *